United States Patent [19]

Boudet

[11] 3,950,580

[45] Apr. 13, 1976

[54] MEANS FOR DISPLAYING THE ADDRESS ON LETTERS AND PARCELS WITH A VIEW TO THEIR DISPATCH

[76] Inventor: Pierre Louis Emile Boudet, 119, bld Jean Jaures, Chatou (Yvelines), France

[22] Filed: Mar. 24, 1975

[21] Appl. No.: 561,240

Related U.S. Application Data

[63] Continuation of Ser. No. 327,115, Jan. 26, 1973, abandoned.

[30] Foreign Application Priority Data

Feb. 2, 1972 France ..... 72.03502

[52] U.S. Cl. ..... 428/41; 40/10 R; 40/159; 156/249; 229/80; 283/1 B; 428/81; 428/83; 428/84; 428/194; 428/202; 428/203

[51] Int. Cl.[2] B65D 27/06; B65D 27/16; G09F 3/18

[58] Field of Search ..... 428/14, 40, 41, 81, 83, 428/84, 194, 202, 203; 40/159, 2.2, 10 R; 229/80; 283/1 B; 156/248, 249

[56] References Cited

UNITED STATES PATENTS

| | | | |
|---|---|---|---|
| 2,956,703 | 10/1960 | Royal | 156/249 |
| 3,293,786 | 12/1966 | Anderson | 40/159 |
| 3,517,106 | 6/1970 | Chase | 156/249 |

*Primary Examiner*—J. C. Cannon
*Attorney, Agent, or Firm*—Hubbard, Thurman, Turner & Tucker

[57] ABSTRACT

Transparent sheet having peripheral adhesive area designed to form enclosure enabling viewing of material upon adhesive engagement of the sheet with a substrate wherein a specifically defined section of the peripheral adhesive area is serially renewable enabling repeated engagement and disengagement of the defined adhesive section and substrate and access to the pocket formed and material contained therein.

7 Claims, 1 Drawing Figure

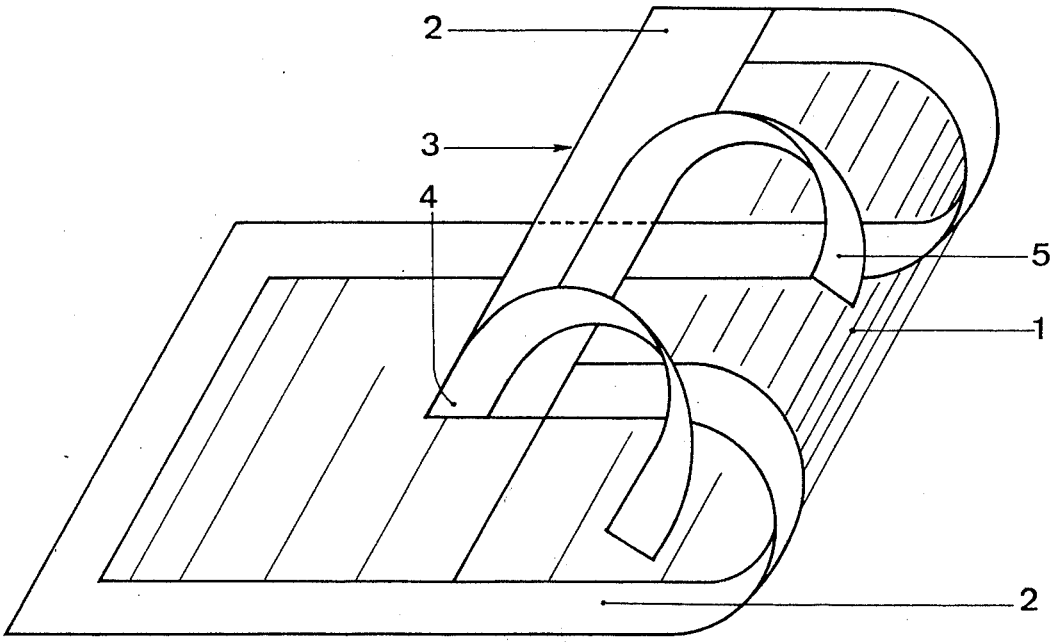
2
3
4
5
1
2

MEANS FOR DISPLAYING THE ADDRESS ON LETTERS AND PARCELS WITH A VIEW TO THEIR DISPATCH

This is a continuation of application Ser. No. 327,115, filed Jan. 26, 1973 and now abandoned.

The invention relates to a device for displaying an address on letters and parcels with a view to their dispatch.

Up to the present, letters and parcels have been addressed by direct printing onto the envelope of the letter or parcel.

This mode of addressing has the disadvantage that the address is exposed to the atmosphere, manipulation and friction during transport, which can cause the partial or total obliteration of the address.

The object of the present invention is to overcome these disadvantages by providing a means for displaying and protecting the address on letters and parcels.

The invention relates, to this end, to a device for displaying the address on letters and parcels, said device being characterized in that it is in the form of a transparent sheet of film made of flexible material, such as plastic or light transmitting paper, said sheet comprising, along its edges, an adherent coating which is applied onto the letter or parcel to form a pocket for receiving the address document.

The device according to the invention is shown in perspective in the accompanying single FIGURE.

According to the invention, the display device for letters or parcels for protecting the address consists of a sheet 1, made of transparent material, in the form of a flexible sheet, shaped or not, which can be fixed to an object so as to form a pocket.

This sheet 1 comprises, on three of its sides, an adherent or self-adherent surface, which is in the form of a marginal edge 2. The fourth side of the sheet also is edged with an adhesive or self-adhesive surface 3, larger than the first three of these sides.

In the case of a self-adhering adhesive, that is, an adhesive which is adherent without being dampened or otherwise treated, the marginal edges are coated with one or more protective film strips which may be selectively peeled away to expose the adherent coating surfaces.

The fourth side of the sheet is divided longitudinally into several adhesive strips each covered by a film strip such as bands 4 and 5, so that, after opening the pocket, it can be used again, for example, for returning the parcel to the sender.

The display device is used in the following way :

the three sides of the sheet are fixed onto the letter or parcel by glueing, so as to form a pocket, between the sheet and the surface of the letter or parcel, into which the address of the addressee is slipped. This address can be on a dispatch note or an invoice.

After introducing the address document, the pocket is closed by application of the fourth side of the sheet, after previously having removed the protective band 4 over the adhesive. After closing, it is possible to have access to this document by eliminating the portion of marginal edge 2 which had been covered by the first band 4. The band 5, which has not yet been used, may be removed to reclose the pocket, for instance, for returning the parcel to the sender. The device is used in all cases where it is desired to have a neat and protected presentation of an address, a document, a photograph, a leaflet, a dispatch note, or an object of substantial bulk. In the last case, the sheet can be shaped according to the shape of the object, so that an object of lesser or greater bulk can be lodged in the pocket formed in this way.

The display device can also be applied for the dispatch of export documents. In that case, it is possible to check the documents that are inside the pocket of the device, it not being required to provide for the replacement of the original device applied on the letter or parcel to be transported. This device can also be used to send various small objects, for example, a watch for repair purposes. The same device can be used for returning the watch to the sender.

It is obvious that the invention is not limited to the examples of its embodiment herein above described and illustrated. If necessary, other means and methods of embodiment can be used without departing from the scope of the invention.

What is claimed is:

1. A device for affixing an article to a parcel wherein said article is visible while being enclosed in a protected pocket, comprising:

a light-transmitting sheet having a periphery surface to be attached to the face of the parcel to form said pocket;

first adhesive strip means having an adhesive coating on a first portion of said periphery surface for attaching said first portion to the parcel;

second adhesive strip means having an adhesive coating on a second portion of said periphery surface for attaching said second portion to the parcel to form said enclosed pocket, said second adhesive strip means including a plurality of adhesive strips independently detachable from said periphery surface for successive engagement of said parcel; and removable strip means covering said first and second adhesive coatings, including a plurality of separately removable tape strips covering said second portion of said periphery surface, said strips each being selectively removable to expose one of said plurality of adhesive strips to the parcel, whereby said second portion is adapted for repeated engagement and disengagement with said parcel as one of said adhesive strips which is attached to said parcel is separated from said periphery surface and as a tape strip is removed from the adhesive strip immediately adjacent said separated adhesive strip to provide for repeated access to said article in said pocket.

2. The device of claim 1 wherein each of said adhesive strips is separately removable from said second portion of said periphery to disengage said second portion from said parcel and provide access to said article.

3. The device of claim 1 wherein said light-transmitting sheet comprises a rectangular flexible transparent sheet, said first portion of said periphery surface comprises a marginal strip along three sides of the rectangular sheet and said second portion of said periphery surface comprises a marginal strip along the fourth side of the rectangular sheet.

4. The device of claim 1 wherein said sheet comprises a flexible flat cover sheet for forming a pocket substantially flush with the parcel surface to contain and display an address document.

5. The device of claim 1 wherein said sheet is shaped to form a pocket projecting substantially outward from the parcel to enclose bulky articles.

6. A device for affixing an article to a parcel wherein said article is visible while being enclosed in a protected pocket, comprising a rectangular flexible transparent sheet having a periphery surface to be attached to the face of the parcel to form said pocket, said periphery surface having an adhesive coating on the entire periphery surface for attaching said surface to the parcel; and a plurality of tape strips covering said adhesive coating, said strips being removable to expose said adhesive coating to said parcel, said strips including a plurality of independently removable parallel tape strips positioned adjacent each other on one side of said periphery surface, said parallel strips each being selectively removable to each expose a separate portion of said adhesive coating on said one side of said periphery surface whereby said one side of said periphery surface may be repeated attached to said parcel as one of said separate portions of adhesive coating on said one side which is attached to the parcel is separated from said one side of said periphery surface and as one of said parallel strips is removed to expose a portion of adhesive coating adjacent to the removed portion.

7. The device of claim 6 whrein said plurality of independently removable parallel tape strips comprises outer and inner adjacent tape strips covering outer and inner adhesive strips respectively of said adhesive coating on said one side of said periphery surface, said outer adhesive strip being removable from said periphery surface after attachment to said parcel to provide access to said article in said pocket, said inner adhesive strip being independently attachable to said parcel with said outer adhesive strip removed to reseal said pocket.

* * * * *